US007021858B2

(12) United States Patent
Beloreshka et al.

(10) Patent No.: US 7,021,858 B2
(45) Date of Patent: Apr. 4, 2006

(54) DOUBLE JOINTS PAVEMENT SYSTEM

(76) Inventors: Temenuzhka Bencheva Beloreshka, 16825 Forest View Dr., Tinley Park, IL (US) 60477; Nikolai Angelov Beloreshki, 16825 Forest View Dr., Tinley Park, IL (US) 60477

( * ) Notice: Subject to any disclaimer, the term of this patent is extended or adjusted under 35 U.S.C. 154(b) by 0 days.

(21) Appl. No.: 10/776,208

(22) Filed: Feb. 12, 2004

(65) Prior Publication Data

US 2005/0180818 A1 Aug. 18, 2005

(51) Int. Cl.
*E01C 11/02* (2006.01)
*E01C 11/06* (2006.01)

(52) U.S. Cl. ..... 404/65; 404/47

(58) Field of Classification Search ..... 404/48, 404/134, 47, 53–58, 67–71, 50, 51, 64, 65; 14/73.1

See application file for complete search history.

(56) References Cited

U.S. PATENT DOCUMENTS 2,032,814 A * 3/1936 Robertson ..... 404/48
2,425,883 A * 8/1947 Jackson ..... 52/309.17
3,956,557 A * 5/1976 Hurst ..... 428/167
3,982,365 A * 9/1976 Noel et al. ..... 52/125.4
4,346,542 A * 8/1982 Tateno ..... 52/396.02
4,727,690 A * 3/1988 Honeyman ..... 52/98
4,884,384 A * 12/1989 Ljungkvist et al. ..... 52/745.05
5,052,852 A * 10/1991 Connolly et al. ..... 404/50
5,092,091 A * 3/1992 Hull et al. ..... 52/396.02
5,129,754 A * 7/1992 Brower ..... 404/65
5,229,402 A * 7/1993 Kajitani et al. ..... 514/343
5,363,619 A * 11/1994 McPhee ..... 52/367
5,450,699 A * 9/1995 Lee ..... 52/396.02
6,739,805 B1 * 5/2004 Shotton ..... 405/267

* cited by examiner

*Primary Examiner*—Raymond Addie

(57) ABSTRACT

A construction joint implement and method for its use in the construction of surface pavement (e.g., roads, highways, airports, and parking lots of concrete or asphalt) comprise a trapezoidal shaped reinforcing beam or a modified reinforcing beam made of a rigid material such as concrete and placed along the entire length of the joint and not bounded to either part of the slab. The beam supports both edges along the entire length of the joint and avoids the need for Dowel bars. The beam has a large base which distributes the load on large area, leading to decreasing pressure and reduced deformation on the base. Water stops may be built in on both sides of the beam to make the beam fully waterproof. Multiple beams divide the width of pavement into strips. Every strip can then be filled independently using smaller-sized paving machines (e.g., roller or vibro screeds).

5 Claims, 9 Drawing Sheets

DOUBLE JOINTS PAVEMENT SYSTEM

BACKGROUND OF THE INVENTION

1. Field of Invention

Figure 1B:
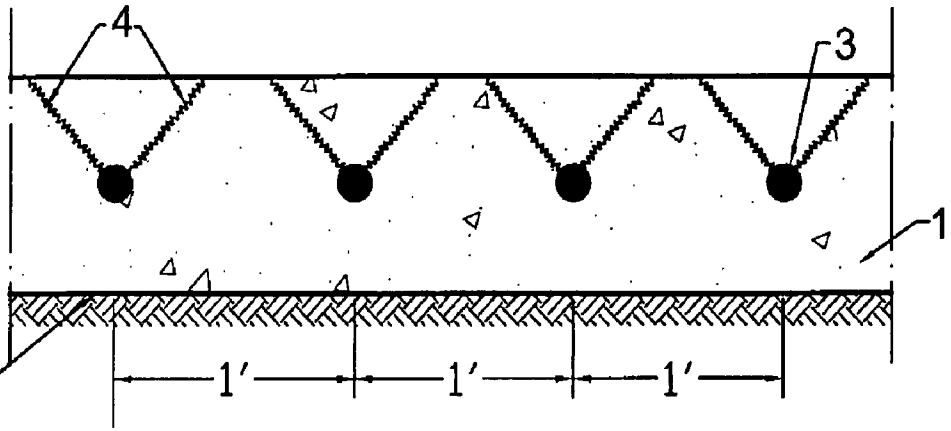
FIG.1b PRIOR ART

This invention relates to joints used in the construction of pavement.

2. Description of Related Art

Temperature changes cause materials and structures to contract and expand. This process is the main force responsible for the cracking and premature destruction of pavement. These adverse effects are further accelerated and exacerbated by prolonged exposure to frequent and substantial temperature fluctuations.

To prevent this from happening, longitudinal or transversal joints are employed. These partition the pavement into small fields, which expand and contract independently of each other.

The highest level of stress and deflection in pavement is found at the joints. For highway pavement, the stress is highest along the longitudinal and transversal joints and the deflection is highest at the corners.

Among the most commonly used methods aimed at enhancing the performance of transverse and longitudinal joints are the following:

(i) Increasing the thickness of the slab and base course in order to improve aggregate interlock;

(ii) Protecting the base and sub-grade against water intrusion;

(iii) Installing permeable base materials;

(iv) Reducing joint spacing; and (v) Installing load transfer devices (e.g., Dowel bars).

Industry practice and research have determined that the latter technology is vary effective in maintaining load transfer throughout the life of the pavement. Dowel bars' ability to reduce faulting by limiting vertical joint movement further enhances the joint load transfer efficiency. Contraction joints with built-in Dowel bars during original construction normally maintain adequate deflection load transfer (70–100% from the loaded to the unloaded slab).

These contraction joints are employed according to the following procedure:

1. Dowels are placed by welded Dowel assemblies fastened to the base by mechanical means.
2. Concrete is set along the entire width and length of the area under construction.
3. After the concrete has set, it is cut by concrete saws to a 7.5 cm depth and minimum of 3 mm width. The joint is cleaned with compressed air and is filled with sealant material.

These contraction joints suffer from a number of disadvantages:

1. Uneven process of joints setting.

Due to the weight of passing vehicles, the pavement, already partially sawn to a 7.5 cm depth, may crack further down, potentially resulting in the pavement being sawn off completely across its entire depth.

2. Technology requires large amounts of steel.

Large amount of steel is used for the Dowel bars in each joint. The load from the passing vehicles exerts pressure on the Dowel bars, possibly cutting them. This requires the diameter of the Dowel bars to be as large as 1.5" (3.8 cm). The length of the Dowel bars is, in most cases, 18" (46 cm). The Dowel bars are placed symmetrically on both sides of the joint. The Dowel bars carry the load independent of one another. This requires the Dowels bars to be arranged in short distances from one another with a cross section with circumference of 12" (30 cm).

3. Technology fails to provide complete and reliable waterproofing.

The joint is not completely waterproof, a deficiency that is the main reason for the formation of cracks along the joints. The sealant, which is set in hot condition, fills completely the joint space and sticks to the sides. At low temperatures the material becomes brittle (largely due to the vibration motion of the vehicles). The resulting cracks destroy the connection with the sides of the joints. This process enables water to go through the joint and reach the base of the pavement. As a result, the base of the pavement is softened and ultimately deformed. The repeated freezing and thawing of the water in the joints further exacerbates the problem: it leads to failure of the concrete around the joint and to widening of the joint. The water in the base of the pavement makes the base softer and therefore decreases its bearing capabilities.

4. Method is technologically and economically sub-optimal.

The Dowel bars need to be placed before further work can be conducted. This prevents concrete trucks from moving along the strip where concrete is to be poured. Concrete trucks must then move outside the lane, requiring valuable space and preventing simultaneous work on multiple lanes. Furthermore, special machines are needed to complete the pouring of the concrete, which results in increased production costs.

OBJECTS AND ADVANTAGES OF THE INVENTION

Several objects and advantages of the proposed invention are:

1. The Reinforcing Concrete Beam ("RCB") and Modified Reinforcing Concrete Beam ("MRCB") are rigid concrete beams, which enable the creation of a new technology, the Double Joints Pavement System ("DJPS"), for pavement placement.
2. The application of the DJPS allows for substantial increase in product quality and durability, productivity, and speed of execution, while achieving significant cost reduction.
3. The large base of the RCB and MRCB distributes the surface loads over a larger area along the entire length of the joint onto a larger area, thus reducing the pressure and deformation in the base and avoiding the need for Dowel bars.
4. The two sloped sides of the RCB (MRCB) provide reliable support to both sides of the slab along the entire length of the joint and allow for free contraction and expansion of the slabs.
5. Water stops embedded in grooves on either side of the RCB (MRCB) create near-perfect waterproofing.
6. The technology also allows for the efficient drainage of water collected between two parallel RCB (MRCB) and for the timely removal of snow.
7. The use of RCB (MRCB) makes it easier and more cost-efficient to protect the freshly placed pavement from rain, snow, and freezing.
8. The DJPS technology solves one of the maim challenges in road construction—the ability to pave under adverse climate conditions (e.g., winter, snow, rain).

9. The DJPS employs RCB (MRCB) to divide the worksite area into parallel strips of width that allows them to be filled efficiently, independently and simultaneously by different work crews and machines (e.g., concrete mix trucks can move freely on both sides of the strips).
10. The DJPS eliminates the existing dependency, under current technology, on heavy tools and machinery, instead relying on the use of cheaper and more flexible smaller-sized paving machines (e.g., roller screeds and vibro screeds).
11. The DJPS is suitable for use in the construction of, among others, concrete and asphalt pavement (e.g., roads, highways, airports, parking lots).

SUMMARY

This invention regards a new technology, Double Joints Pavement System, suitable for use in the construction of, among others, concrete and asphalt pavement (e.g., roads, highways, airports, parking lots). The technology employs joint construction implements, (Modified) Reinforcing Concrete Beams, in order to divide the worksite area into parallel strips, allowing them to be filled independently and/or simultaneously using smaller-sized paving machines (e.g., roller screeds and vibro screeds).

DRAWINGS—FIGURES

In the drawings, closely related figures may have the same number but different alphabetical suffixes.

Figure 1A:
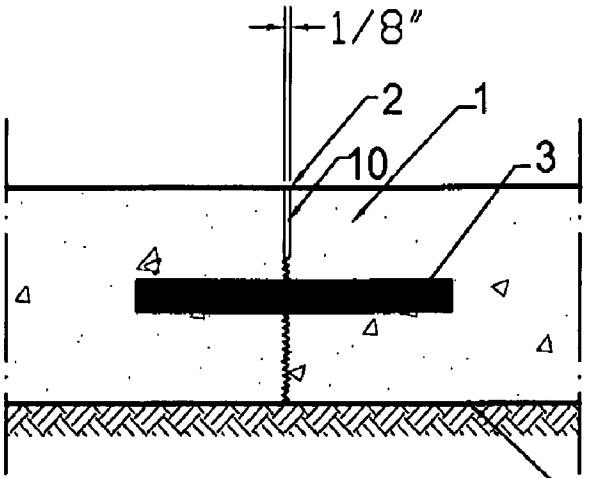
FIG. 1a PRIOR ART

FIG. 1*a*. Vertical transversal cross-section of a joint used in currently existing technology.

FIG. 1*b*. Vertical longitudinal cross section of a joint used in currently existing technology.

Figure 2:
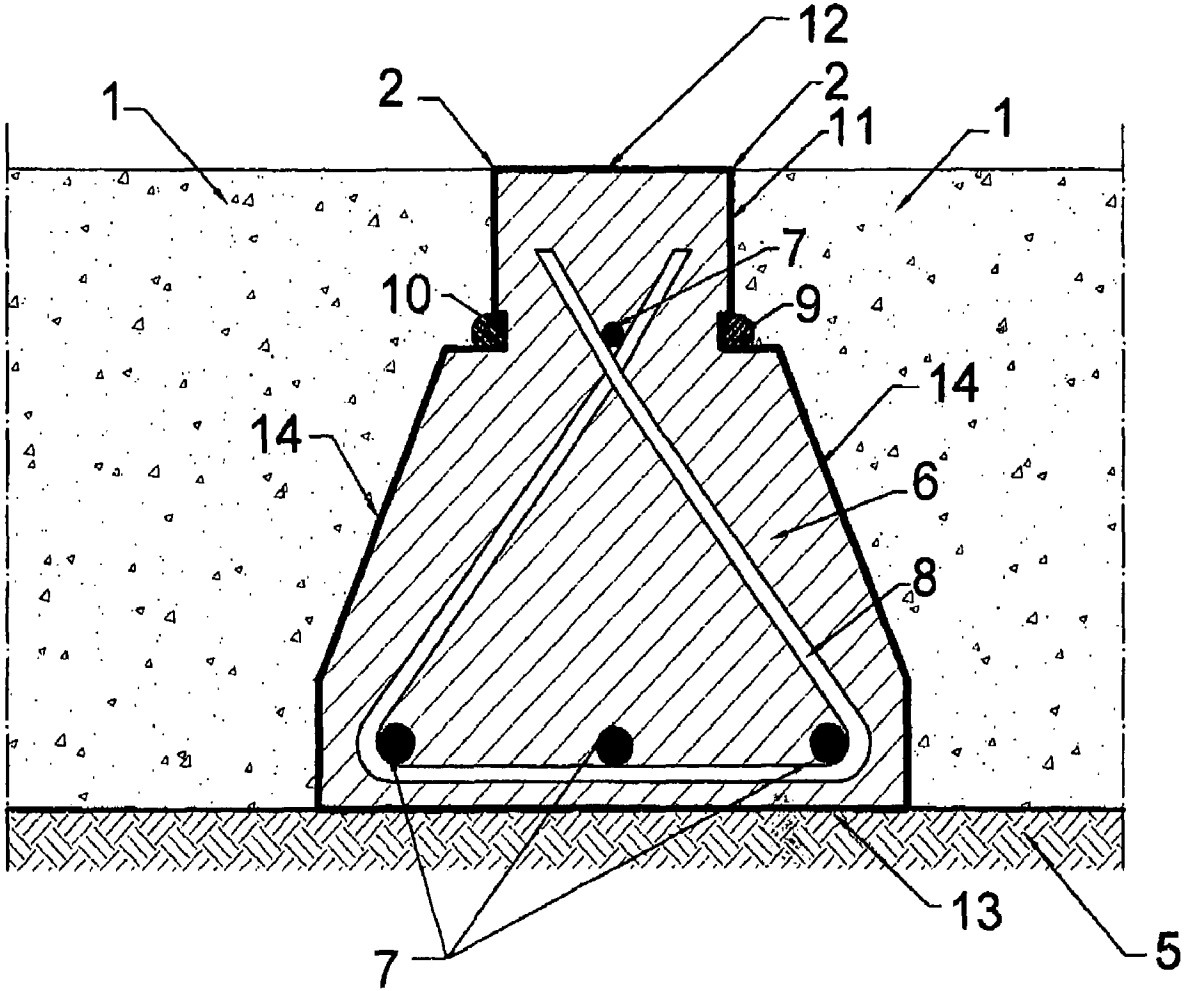

FIG. 2. Vertical transversal cross section of Reinforcing Concrete Beam (RCB), Variant 1.

Figure 3:
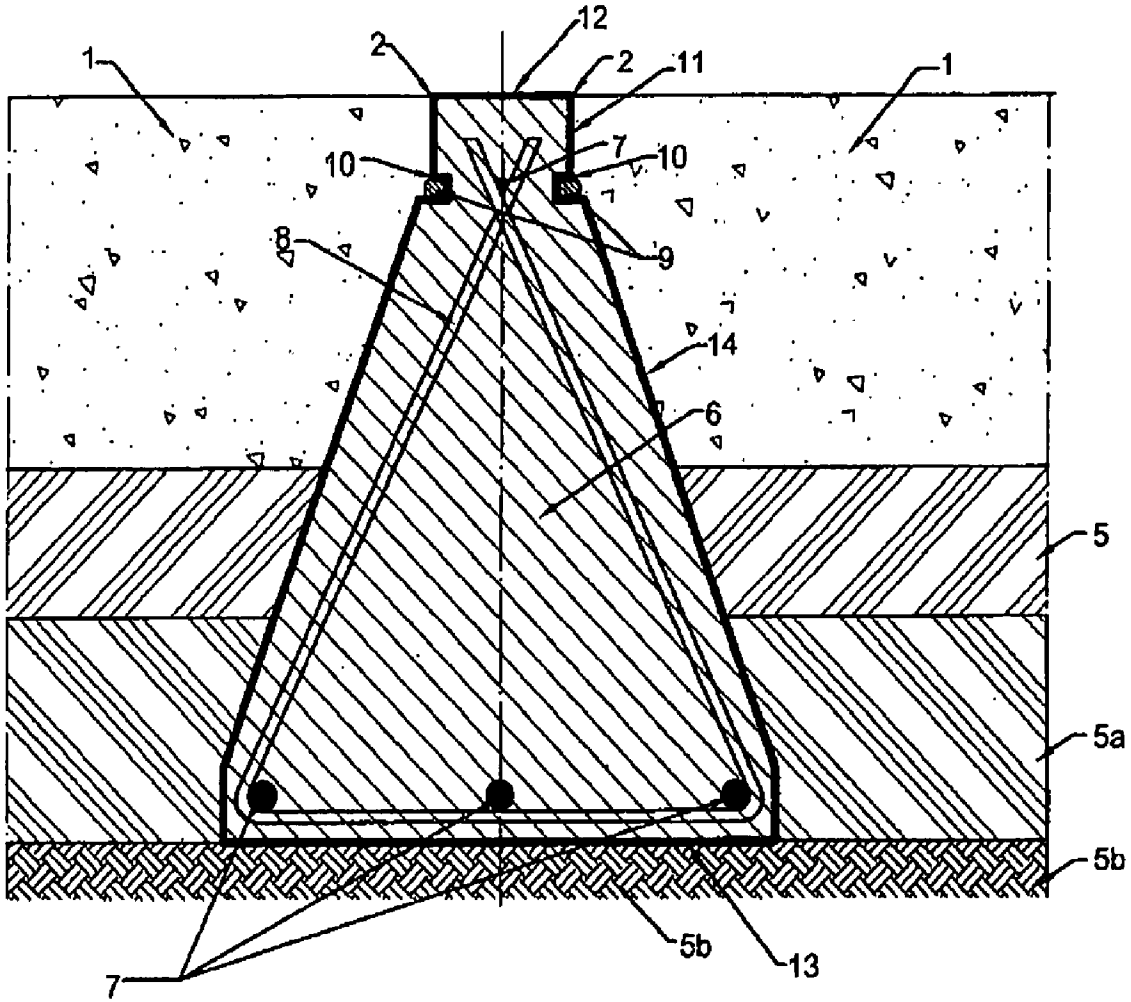

FIG. 3. Vertical transversal cross section of Reinforcing Concrete Beam (RCB), Variant 2.

Figure 4:
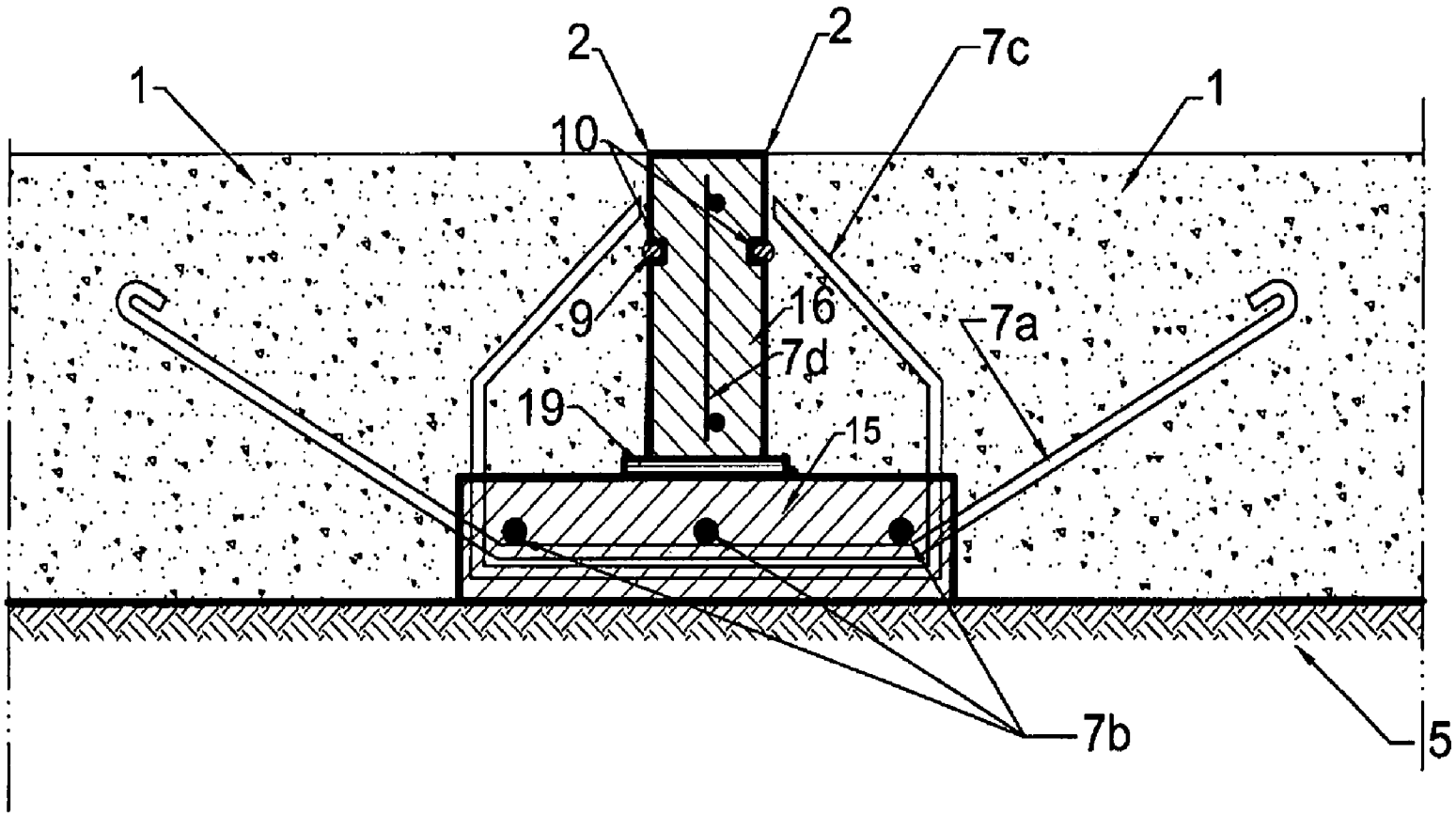

FIG. 4. Vertical transversal cross section of Modified Reinforcing Concrete-Beam (MRCB), Variant 3.

Figure 5A:
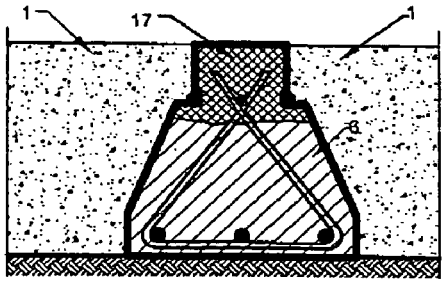

FIG. 5*a*. Vertical transversal cross section of RCB-composite construction, Variant 1*a*. RCB's height is equal to or less than the height of the pavement.

Figure 5B:
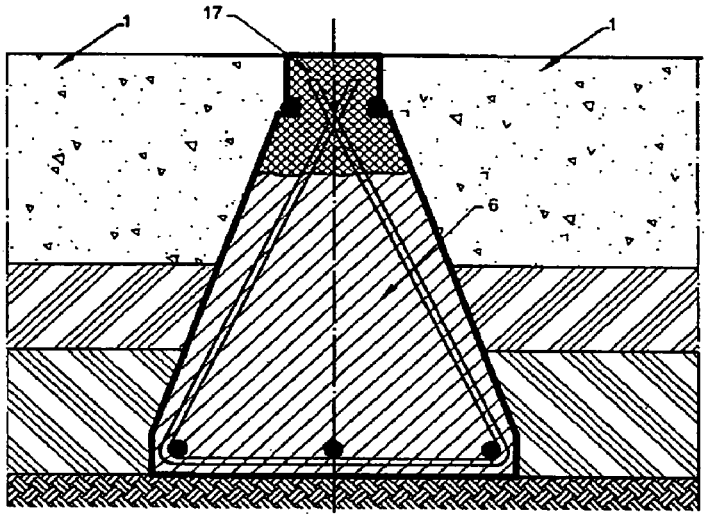

FIG. 5*b*. Vertical transversal cross section of RCB-composite construction, Variant 2*a*. RCB's height is greater than the height of the pavement.

Figure 5C:
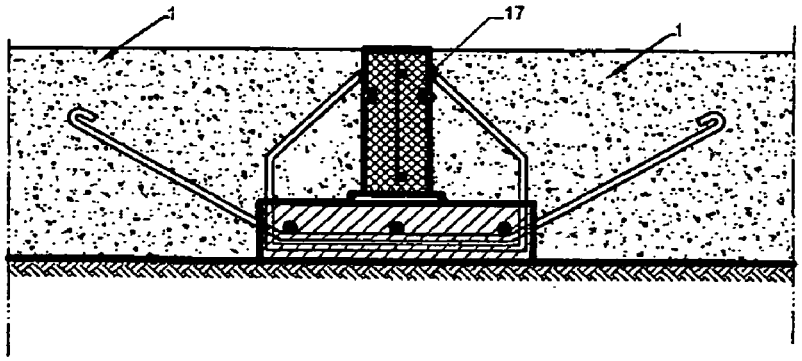

FIG. 5*c*. Vertical transversal cross section of MRCB-composite construction, Variant 3*a*.

Figure 6A:
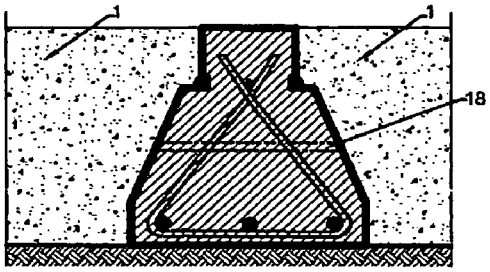

FIG. 6*a*. Vertical transversal cross section of RCB with opening for Dowel Bars, Variant 1*b*

Figure 6B:
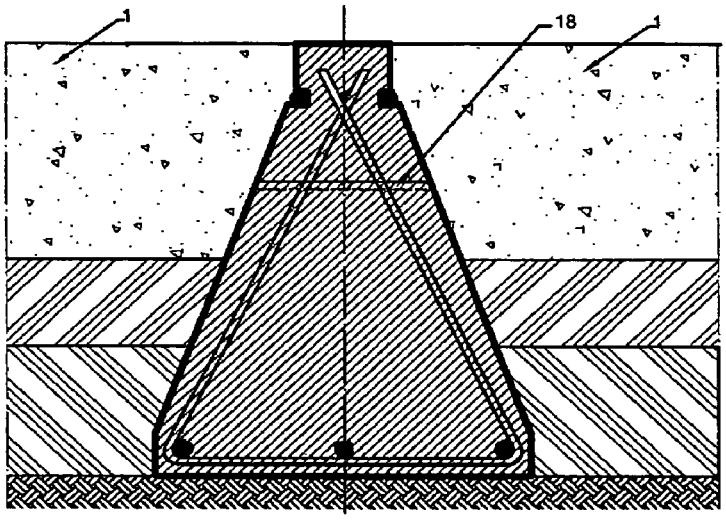

FIG. 6*b*. Vertical transversal cross section of RCB with opening for Dowel Bars, Variant 2*b*

Figure 6C:
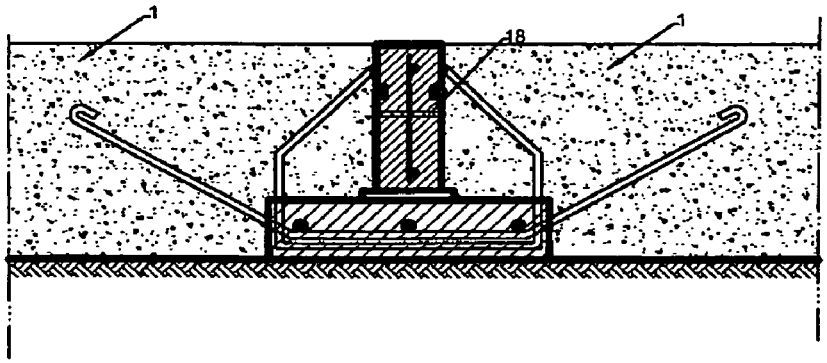

FIG. 6*c*. Vertical transversal cross section of MRCB with opening for Dowel Bars, Variant 3*b*

Figure 7A:
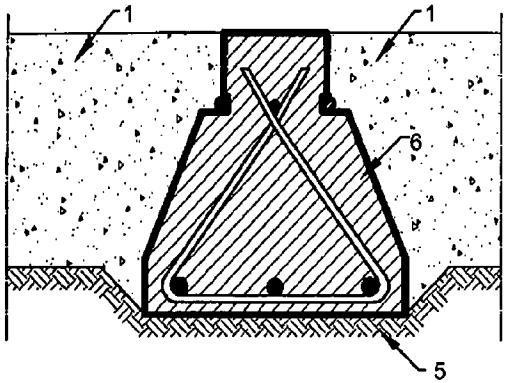

FIG. 7*a* Vertical transversal cross section of RCB partially dug into the base course, Variant 1*c*.

Figure 7B:
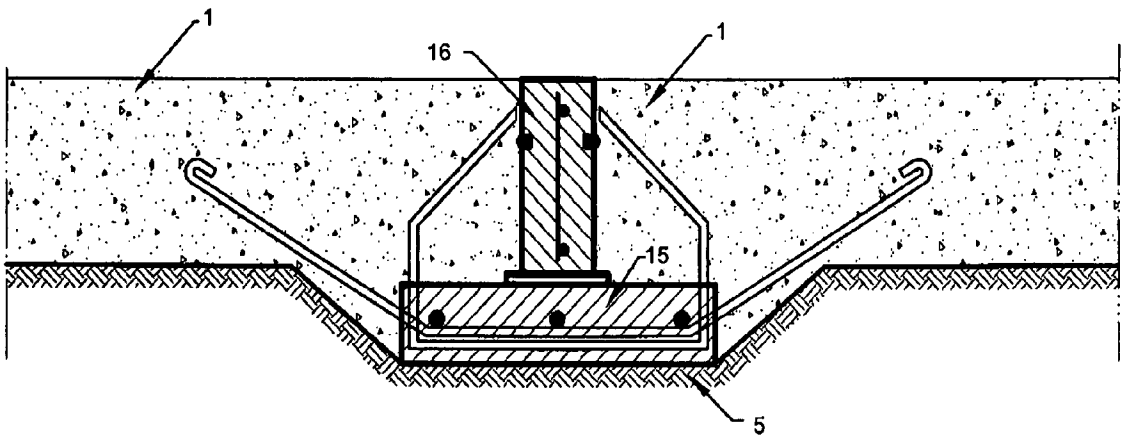

FIG. 7*b* Vertical transversal cross section of MRCB partially dug into the base course, Variant 3*c*.

Figure 8A:
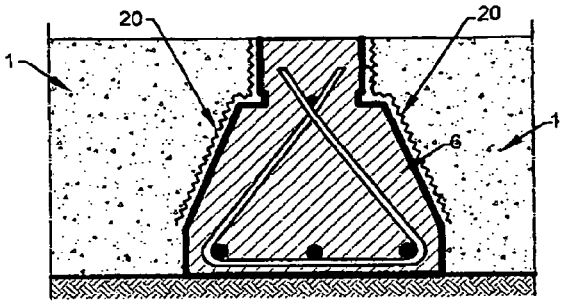

FIG. 8*a* Vertical transversal cross section of RCB with sheet water barrier, Variant 1*d*.

Figure 8B:
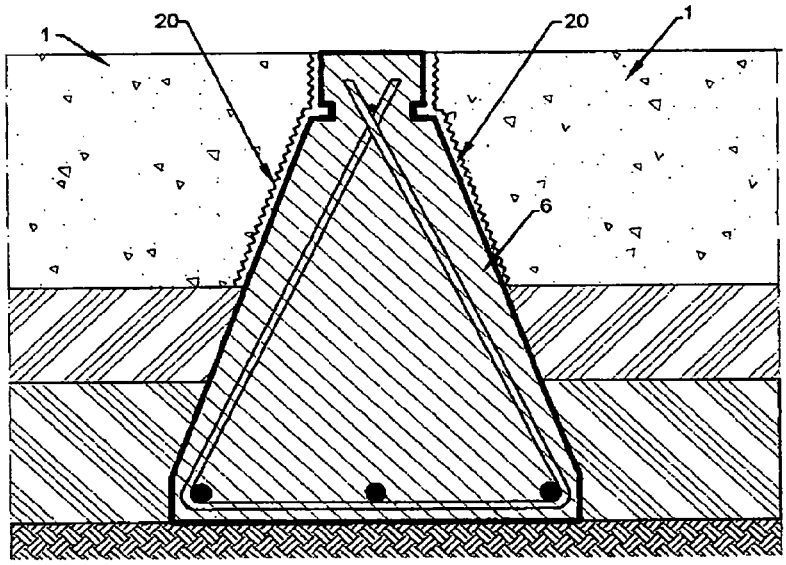

FIG. 8*b* Vertical transversal cross section of RCB with sheet water barrier, Variant 2*d*.

Figure 8C:
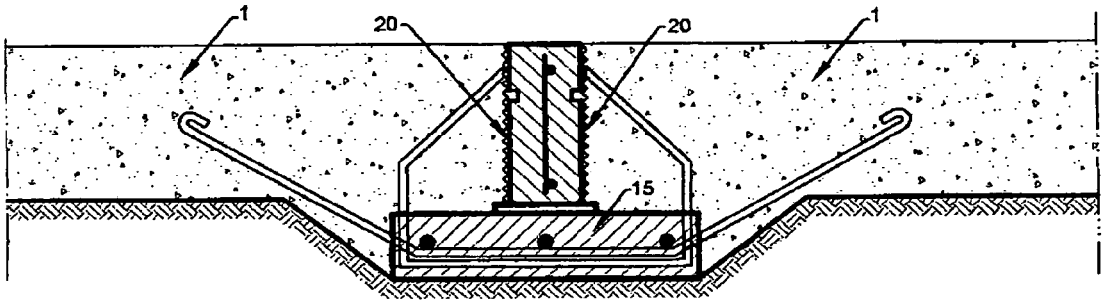

FIG. 8*c* Vertical transversal cross section of Modified Reinforcing Concrete Beam with sheet water barrier, Variant 3*d*.

Figure 9:
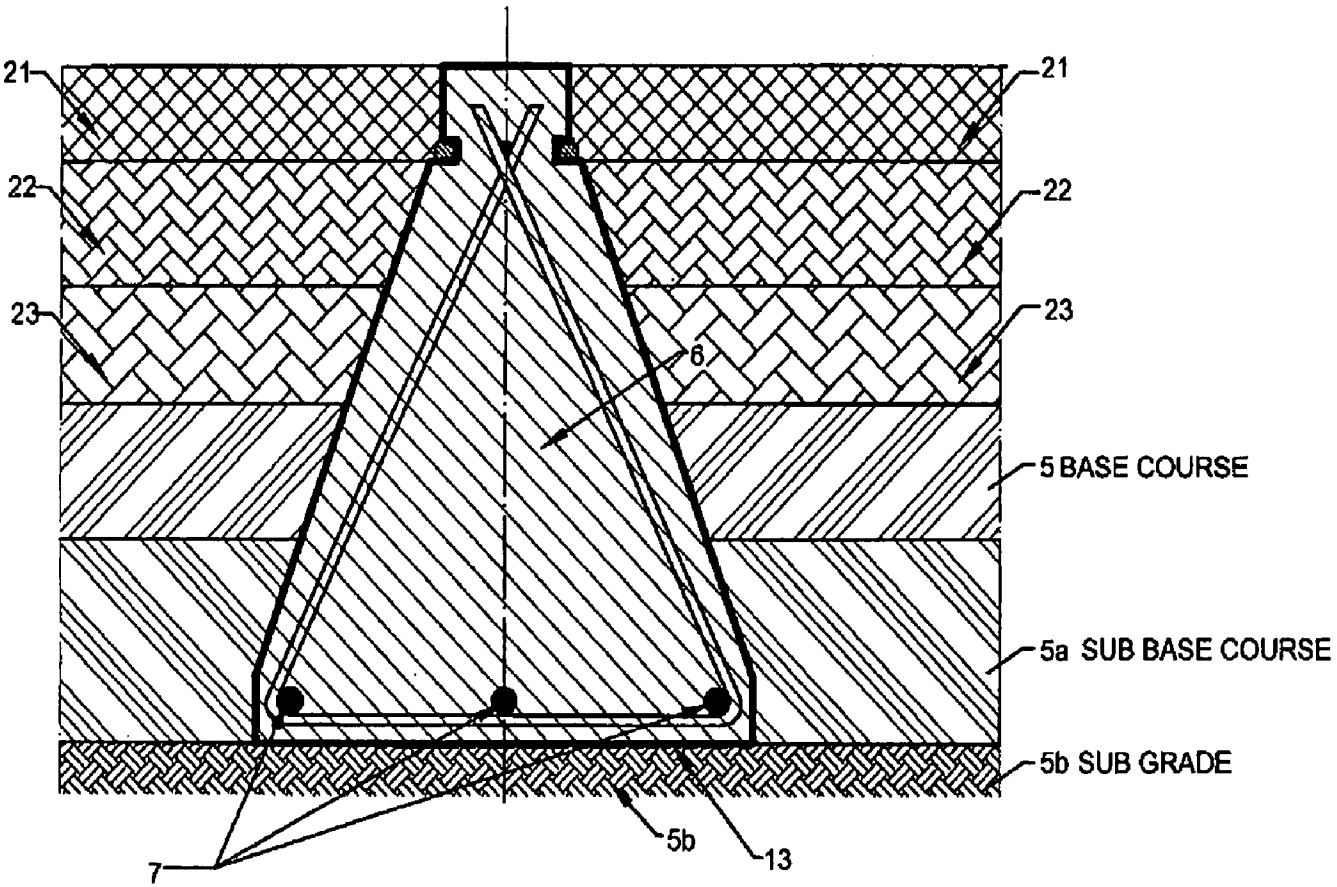

FIG. 9 Vertical transversal cross section of RCB by Perpetual Asphalt Pavement.

DETAILED DESCRIPTION—PREFERRED EMBODIMENT

The DJPS achieves the connection between the two sides of the slab (1) via RCB or MRCB. FIGS. 1–8 illustrate the application of DJPS when the slab (1) is concrete, while FIG. 9 illustrates the application of DJPS when the slab (1) consists of high quality hot mix asphalt (21), high modulus rut resistant material (22), and flexible fatigue resistant material (23) (FIG. 9).

The RCB (6) (FIGS. 2–3), a rigid beam of rectangular-trapezoidal vertical cross-section, is reinforced with rebars (7) and ties (8).

The upper-most horizontal base (12), located at the level of the pavement surface, supports smaller-scale paving placing machines (e.g., roller screeds and vibro screeds). The lower horizontal base (13), larger in size than the upper horizontal base (12), transfers loads to the base course or sub grade. The upper rectangular section of the RCB (6) has a typical vertical height of 4" to 6" (11). Water stops (9) are embedded in grooves (10) along the slanted sides (14) of the RCB (6).

RCB (6) can be cast in place at the construction site or pre-cast ready for immediate use at the construction site.

RCB (6) can be produced, in part or wholly, with stronger and more flexible concrete (FIG. 5*a*, FIG. 5*b*).

RCB (6) can be placed on (FIG. 2) or partially dug into the base course (5) or sub grade (5*a*, 5*b*) (FIG. 3, FIG. 7*a*).

The slanted sides of the RCB (6) support both sides of the slab (1) along the entire length of the joint (2), thus reducing the stresses in the slabs (1). Those may be covered with bituminous or sheet water barrier (20) in order to facilitate the expansion and contraction of the slabs and improve waterproofing (FIG. 8*a*, FIG. 8*b*).

The lack of bonding between the RCB (6) and the pavement allows for the free expansion and contraction of the pavement slabs (1).

While no longer required, Dowel bars (3) can be incorporated into the DJPS technology via the (optional) horizontal openings (18) in the RCB (6) through which the Dowel bars (3) can pass (FIG. 6*a*, FIG. 6*b*).

DETAILED DESCRIPTION—ALTERNATIVE EMBODIMENT

The MRCB (FIG. 4) consists of horizontal (15) and vertical (16) reinforcing concrete panels. The horizontal panel supports simultaneously both edges of the slabs (1). It is situated under slab's edges and allows for the simultaneous turning (hinging) of the edges of the slabs (1) due to temperature fluctuations. The longitudinal rebars (7*b*) placed along the length of the horizontal panel (15) and the steel mesh (7*d*) increase MRCB's rigidity. The connection between the two parallel slabs (1) established via anchor rebars (7*a*) decreases the possibility of disintegration of the slab (1) at the location of the joint (2). The rebars (7*c*) fix the relative space placement of the horizontal (15) and vertical (16) panels. The height of the MRCB may be adjusted via a shim (19).

The horizontal panels (15) can be partially dug into the base course (5) (FIG. 7*b*), thus increasing the MRCB's rigidity.

Water stops (9) placed in grooves (10) along the slanted sides (14) of the MRCB or, alternatively, bituminous or sheet water barrier stops (20) may be used in order to facilitate the expansion and contraction of the slabs (1) and improve waterproofing.

The vertical panels (16) can be produced with stronger and more flexible concrete (17) (FIG. 5*c*).

The vertical panels (16) can be produced with opening for Dowel Bars (3). (FIG. 6*c*).

DETAILED DESCRIPTION—OPERATION

The DJPS technology uses RCB or MRCB to divide the worksite area into parallel strips. Every strip can then be filled independently and simultaneously from the rest using smaller-sized machines (e.g., roller screeds and vibro screeds). The (concrete mix) trucks can move freely on either side of the strips.

The DJPS technology using RCB or MRCB is executed in the following stages:

1. Form the sub-grade using currently employed technologies.
2. Set (line) up RCB/MRCB on the sub grade, dividing the worksite area into parallel strips.
3. Set up and compact the lowest layer (sub-base course, if present) of a parallel strip. Cover the prepared layer with plastic sheet to protect it from adverse weather conditions, e.g., rain, snow, and freezing.
4. Set up and compact the upper layer (base course, of present) of the parallel strip. Cover the prepared layer with a plastic sheet.
5. Set up the pavement. Protect the freshly poured paving materials (e.g., concrete) with a plastic sheet.

We claim:

1. A reinforcing beam for use between adjacent concrete or asphalt slabs, said reinforcing beam comprised of a rigid material, said beam having a vertical cross-section comprising:

an isosceles trapezoid having a bottom base of pre-determined length and a top base of pre-determined length opposite said bottom base, said bottom base length being greater than said top base length;

a rectangle above said isosceles trapezoid and joined to said top base along a rectangle base of pre-determined length, said rectangle base length being not greater than said top base length;

said isosceles trapezoid further comprises a first slanted side connecting said top base to said bottom base, and said first slanted side comprises a first water stop;

wherein said stop comprises a horizontal groove and a bituminous or sheet water barrier.

2. The reinforcing beam as described in claim 1 in which said rigid material comprises concrete.

3. The reinforcing beam as described in claim 1 in which said isosceles trapezoid further comprises a second slanted side opposite said first slanted side and connecting said top base to said bottom base, and said second slanted side comprises a second water stop.

4. A method of using a pavement joint system for use in concrete and asphalt pavement comprising: providing a plurality of joint filler implements comprised of a rigid material in the form of a reinforcing beam having a vertical cross section comprising: an isosceles trapezoid having a top base of pre-determined length, a bottom base of pre-determined length, which is greater in length than and opposite of said top base; said vertical cross section further comprising; a rectangle joined to and disposed upon said isosceles trapezoid cross-section, said rectangular cross-section having a rectangular base, which is of a length not greater than the length of the top base of said isosceles trapezoid cross-section; wherein said isosceles trapezoid has at least a first slanted side connecting the top and bottom bases together and defining a water stop, in the form of a horizontal groove receiving a bituminous or sheet type water barrier, has been added, said plurality of joint filler implements being arranged in parallel rows, providing parallel strips of pavement material into spaces between said plurality of joint filler implements.

5. The method as described in claim 4 in which said rigid material comprises concrete.

* * * * *